US005829650A

United States Patent [19]

MacTaggart

[11] Patent Number: 5,829,650

[45] Date of Patent: Nov. 3, 1998

[54] APPARATUS FOR MAKING FRINGES AND TASSELS

[76] Inventor: Kathleen MacTaggart, #602-60 Inverlochy Blvd, Thornhill, Ontario, Canada, L3T 4T7

[21] Appl. No.: 876,317

[22] Filed: Jun. 16, 1997

[51] Int. Cl.[6] ..... A41M 43/00

[52] U.S. Cl. ..... 223/46; 223/44

[58] Field of Search ..... 223/44, 46, 120

[56] References Cited

U.S. PATENT DOCUMENTS

| | | | |
|---|---|---|---|
| 975,355 | 11/1910 | Gurtler | 223/46 |
| 2,666,249 | 1/1954 | Ruiz et al. | 223/46 |
| 2,799,956 | 7/1957 | Ciroli | 223/46 |
| 3,105,243 | 10/1963 | Kampfe et al. | 223/46 |
| 4,454,968 | 6/1984 | St. Lawrence | 223/46 |
| 4,714,182 | 12/1987 | Heuht | 223/46 |
| 5,356,656 | 10/1994 | Teuten | 223/46 |
| 5,411,188 | 5/1995 | Teufen | 223/46 |

*Primary Examiner*—Bibhu Mohanty
*Attorney, Agent, or Firm*—Jane Parsons

[57] ABSTRACT

Apparatus for making decorative fringes and/or tassels comprises a base having parallel support grooves for a set of combs to support the combs in two parallel rows with their teeth upstanding. Yarn may be looped around and between the teeth to form strands of fringe or tassel. The strands may be secured with adhesive and the loops may be removed from the teeth. The longer loops may be cut if desired.

10 Claims, 7 Drawing Sheets

APPARATUS FOR MAKING FRINGES AND TASSELS

RELATED APPLICATIONS

This application follows disclosure to the U.S. Patent Office of the invention in Disclosure Document No. 399,937 filed Jun. 26, 1996.

BACKGROUND OF THE INVENTION

1. Field of the Invention

This invention relates to apparatus for forming decorative fringes and tassels.

2. Acknowledgement of Prior Art

In fringes and/or tassels, lengths of material are allowed to fall freely from a constraint. For example, lengths of yarn or thread may be bundled to form a tassel either by holding them tightly at one end so that the other ends fall free or by holding them tightly at their mid-points so that both ends fall free. Fringes may be formed in a similar manner except that the lengths are arranged along an elongate holder. Sometimes, fringes and tassels are formed from looped elongate material. The loops hanging freely as described. The loops may be twisted so that each one forms a double thickness thread having a looped end which is not subject to fraying.

The manufacturer of fringes and tassels on a commercial scale has required sophisticated apparatus requiring appreciable set up procedures. Mostly, however, it is necessary to perform the work completely manually. Long runs of any one design of fringe or tassel have been inevitable and the resulting fringes and tassels have been expensive.

On a domestic scale the task of forming fringes and tassels has been equally frustrating. Fringes or tassels with free ends which are subject to fraying may be formed domestically by winding yarn about a measuring card and thereafter bundling it by tying a tyer about the yarn at one edge of the card and cutting the yarn at the other edge of the card. It is not possible to form tassels having twisted looped non-frayable ends by this method. If it is desired to form fringes by this method the strands are not bundled together at one edge of the card but are cut at the other edge of the card and then the discreet lengths of material are arranged as regularly as possible along an elongate holder. It is very difficult to make such fringes accurately regular. Again, fringes made in this manner cannot be made from looped strands which are twisted to appear as a double strand.

Moreover, the provision of decorative tops for the tassels is difficult and time consuming. When such tops are provided they may be wired or glued in position.

The present inventor has attempted to design an easy to use apparatus for making either fringes or tassels in large or small quantities on a domestic basis.

SUMMARY OF THE INVENTION

Accordingly the invention provide apparatus for making decorative fringes and tassels comprising: a plurality of combs, each of which has an elongate spine and a row of teeth projecting from the spine; and means to releasably support at least one pair of said combs with their spines parallel and their teeth upstanding to be slidable in an axial direction.

Preferably the means to support at least one pair of combs comprises a base having at least one pair of parallel grooves each groove being dimensioned to hold the spine of one comb of the pair of combs, the grooves being spaced apart by a distance corresponding to a prechosen strand length for the fringe or tassel. The base may be a rectangular board made from wood, plastics material, metal or other suitable material.

The grooves may be open ended so that the spines of the combs may be slid into them from either end. Each groove preferably has a length sufficient to accommodate two or more combs in end to end relationship so that work started on one pair of combs may be continued on the next adjacent pair of combs without a break. This next adjacent pair of combs may then be slid along their respective grooves to displace said one pair of combs to disengage them from the grooves. Alternatively said one pair of combs may be lifted from the groove, if the respective cooperating shapes of the spines and grooves allow. Said one pair of combs or another pair of combs may then be relocated in the grooves downstream of and adjacent to combs already present in the grooves so that work may be continued.

Tassels produced on apparatus according to the invention may be provided with a suspension cord or thread which may be threaded through a central aperture of a decorative cap for the tassel and secured in any conventional manner.

BRIEF DESCRIPTION OF THE DRAWINGS

An embodiment of the invention will now be described by way of example with reference to the drawings, in which.

DETAILED DESCRIPTION OF A PREFERRED EMBODIMENT

FIGS. 1A, 1B, 1C and 1D show embodiments of fringes and tassels which may be made using apparatus according to the invention.

Figure 2:
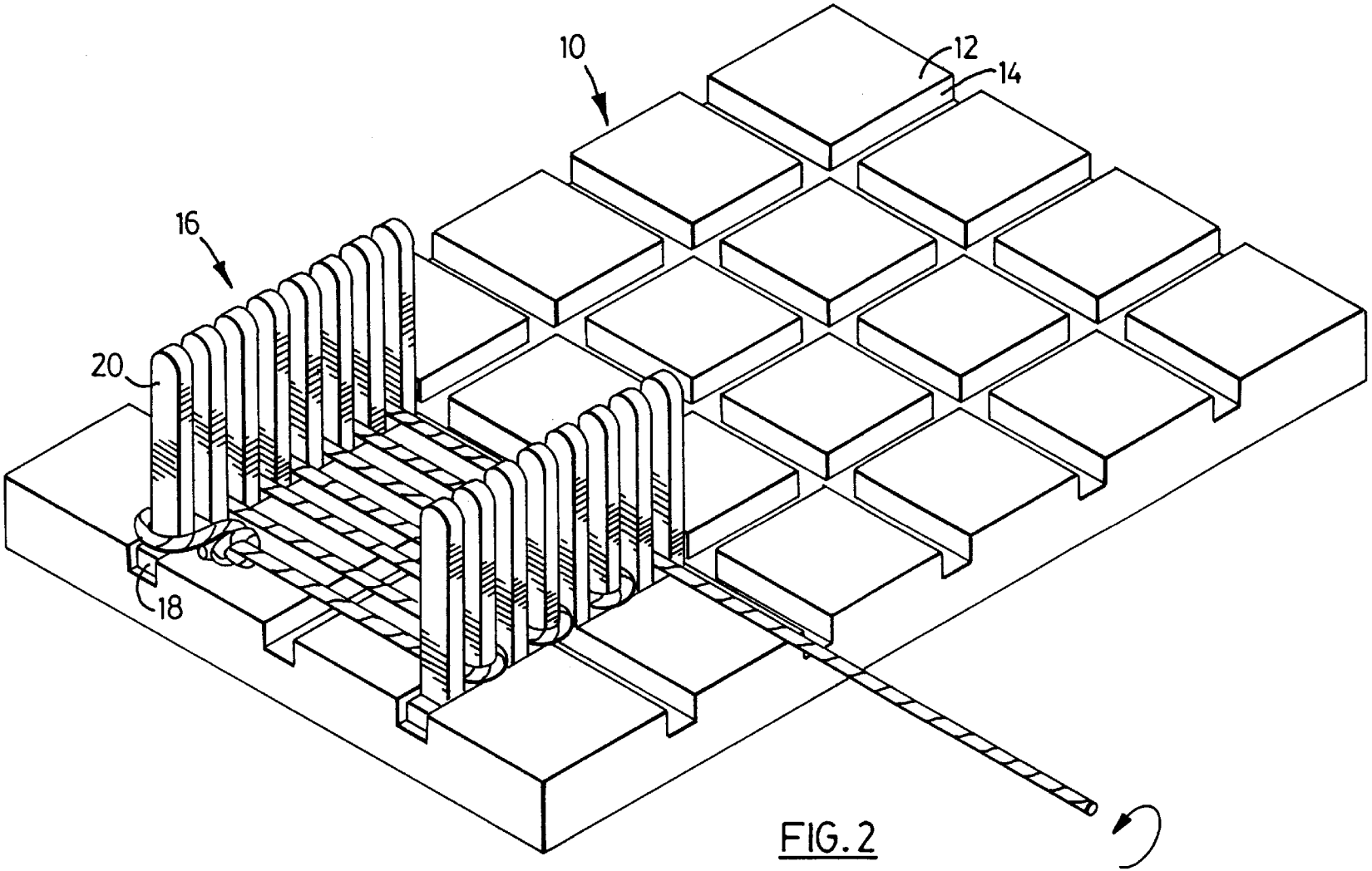
FIG. 2 illustrates apparatus according to the present invention and a method for using it.

FIG. 2 of the drawings illustrates fringe and/or tassel forming apparatus 10. The apparatus comprises a grooved rectangular board 12. Grooves 14 are provided in two sets, the grooves of each set being parallel to one another and to respective opposing edges of the board 12. The grooves 14 of each set are spaced apart by distances such that the distance any two grooves of one set corresponds to a suitable length for a fringe or tassel.

The grooves 14 are dimensioned to hold the spines 18 of combs 16 so that teeth 20 of the combs 16 project vertically upwardly from the board, their spines 18 being lodged securely but slidably in the grooves 14.

As illustrated in FIG. 2, grooves 14 are of U-section with right angles between the base of the U and the sides. Such grooves hold combs 16 which is either of rectangular section or which has a ridge of rectangular section to fit slidably in one of the grooves. The grooves 14 should have sufficient depth that the comb 16 is not easily jerked accidentally loosed from the groove. The grooves 14 are open ended so that combs 16 may be inserted from one end, slid along the length of a groove 14 and removed from the other end.

Figure 5:
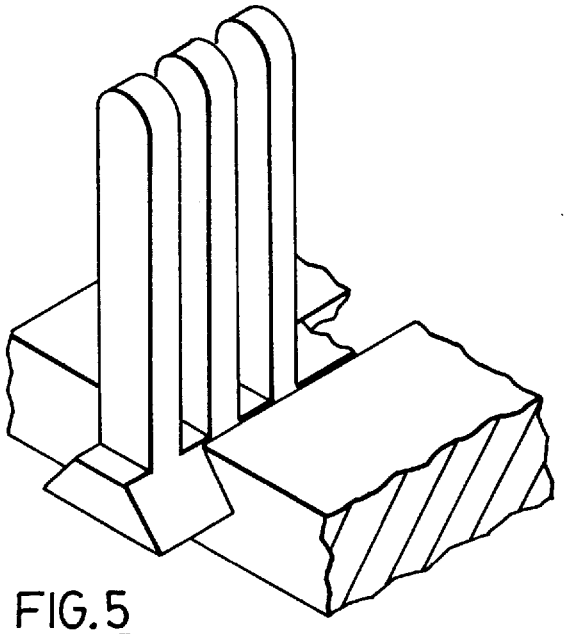
FIG. 5 shows an alternative comb held in a keyhole groove.

For greater security other shapes of mating groove 14 and comb spine 18 may be provided. For example, groove 14 may have a keyhole section for example the triangular keyhole shape shown in FIG. 5 and spine 18 may have a bead along its ridge to fit into the wide portion of the keyhole section. While such an arrangement has the advantage of extreme security, it is necessary to slide the combs into the grooves 14 from either end of the selected groove. In this case, it is not possible to insert comb 16 into groove 14 from the surface of board 12 and remove it by lifting it out of the groove. This may be an inconvenience for some applications.

Figure 4:
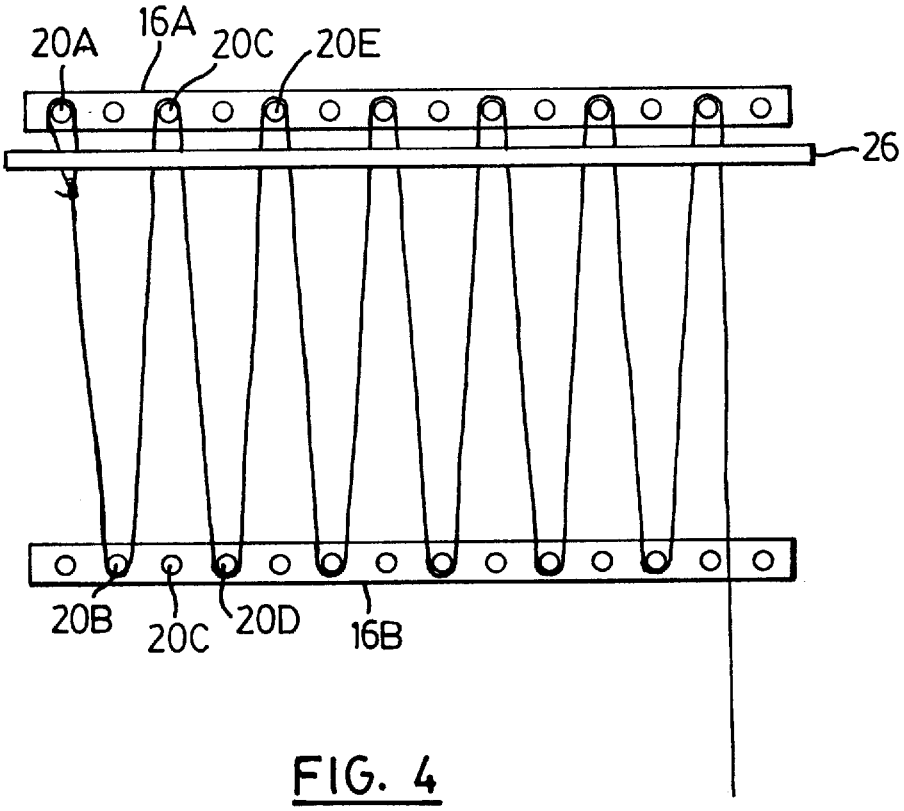
FIG. 4 is a schematic view showing the threading of yarn in the apparatus.

FIG. 4 shows how the yarn is wound onto teeth 20 of a pair of combs 16A, 16B. For clarity the spacing between teeth is greatly increased and the number of teeth shown is minimized. In practice the teeth will be provided in a much greater number and the spacing between them will be much less.

Figure 1A:
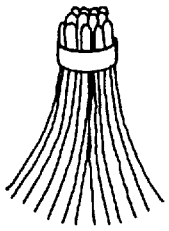
FIGS. 1A, 1B, 1C and 1D are examples of a free end tassel, a free end fringe, a twisted looped end tassel and a twisted looped end fringe respectively.
Figure 1B:
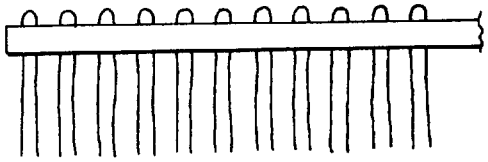
Figure 1C:
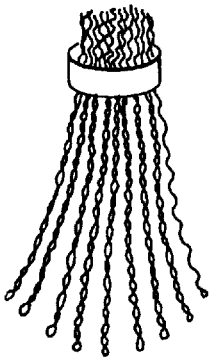
Figure 1D:
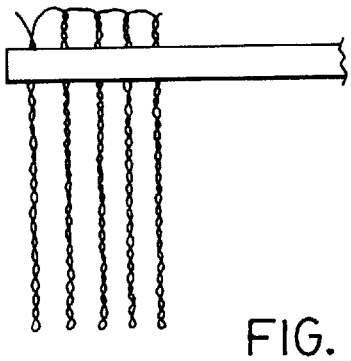
Figure 6A:
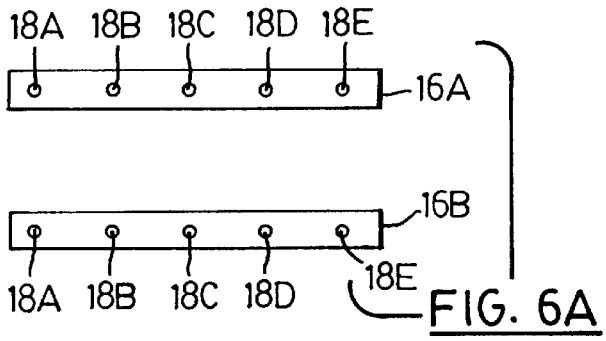
FIGS. 6A, 6B, 6C, 6D, 6E, 6F, and 6G show process steps in using the apparatus.

In operation, for example to make a twisted tassel as shown in FIG. 1C or a twisted fringe as shown in FIG. 1D, the procedure, which is shown in FIGS. 6A – 6G, may be along the following lines:

A rear comb 16 is inserted in a groove 14 and a front comb 16 is inserted in a parallel groove 14 at a distance from the rear comb corresponding with the desired length of fringe or tassel (FIG. 6A).

Figure 6B:
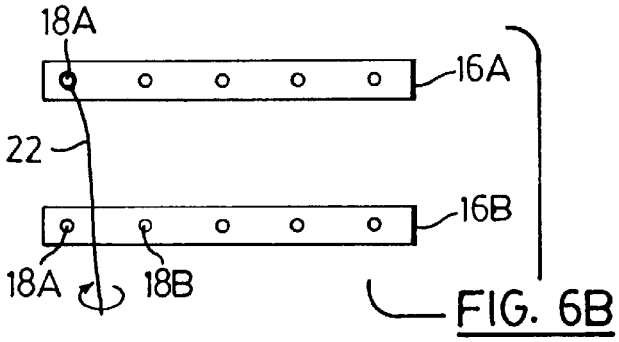

Thread or yarn or other fringe/tassel material 22 is attached to end 18A of rear comb 16A. The yarn 22 is brought forward between teeth 20A and 20B of front comb 16B and the user, located in front of the board and parallel comb 16A, 16B twists the yarn between the fingers (FIG. 6B).

Figure 6C:
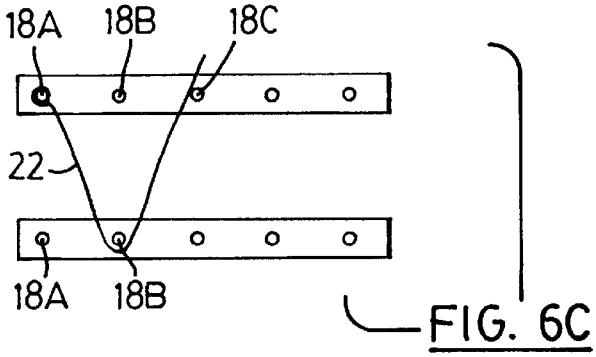

The yarn 22 is then lead around tooth 20B of front comb 16B and rearwardly around tooth 20C of rear comb 16A (FIG. 6C).

Figure 6D:
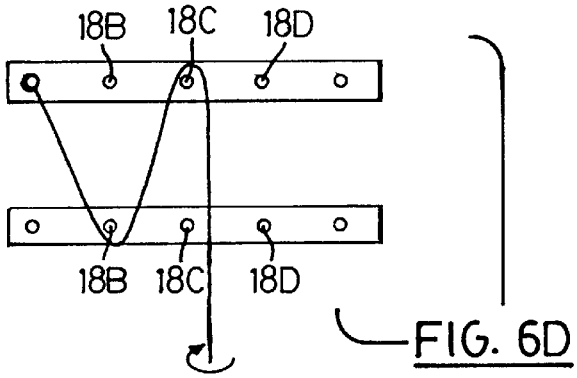

It is then pulled forwardly between teeth 20C and 20D of front comb 16B and further twisted by the operator (FIG. 6D).

The twisted yarn is lead around tooth 20D of comb 16B and rearwardly around tooth 20E of rear comb 16A. It is then lead forwardly for further twisting. This sequence of events is repeated until the ends of the combs are reached.

Figure 6E:
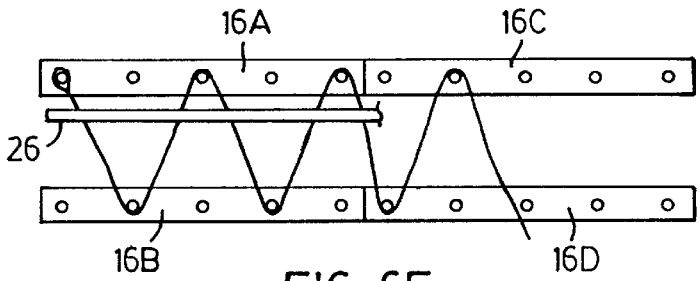
Figure 6F:
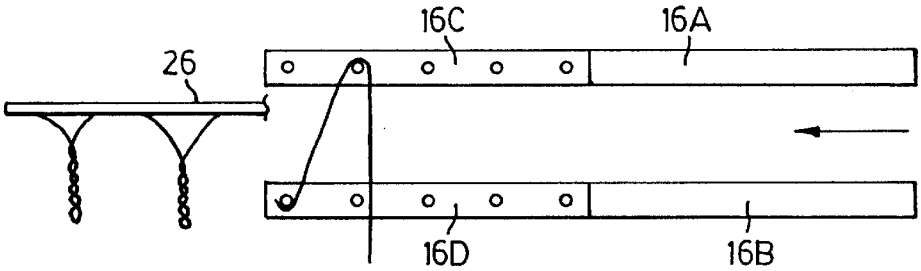
Figure 6G:
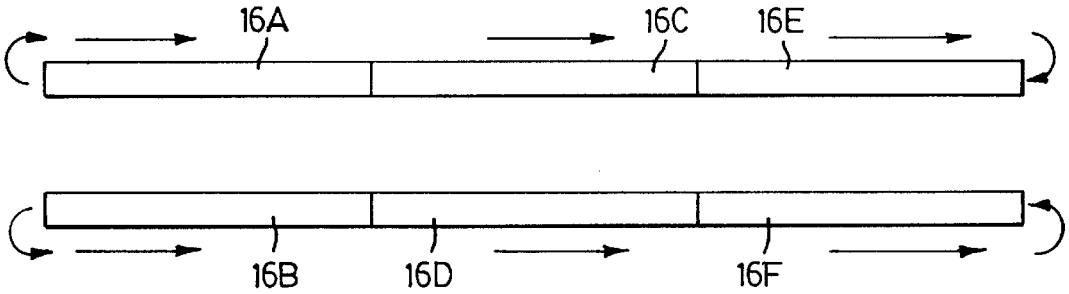

If a fatter tassel or a greater length of fringe is required a further pair of combs 16C and 16B are slotted into the grooves 14 as continuations of combs 16A and 16B (FIG. 6E). The interlacing of the yarn is continued on these combs 16C and 16D.

Once the yarn is being worked on combs 16C, 16D, it is possible to remove the work from combs 16A, 16B. To remove the work from a pair of combs such as 16A and 16B a length of adhesive 26 or other fastening material is laid across the yarn which zig-zags between the teeth of combs 16A, 16B. The adhesive 26 or other fastening material is preferably laid close to one of the combs. After placing the adhesive the work may be lifted of the combs in the form of a fringe because the yarn is twisted the loops of twisted yarn falling away from the adhesive 26 automatically twists together to form a two ply strand of the fringe or tassel. The adhesive 26 regulates the spacing of the strands one from the other. If a tassel is required, the adhesive is coiled after removal of the work from the combs. The adhesive is conventionally adhesive tape.

If tassels or fringes with free ends are required as shown in FIGS. 1A and 1B, then the yarn is not twisted by the operator and the loops may be cut at the teeth 20A, 20B, 20C . . . of front combs 16B after placing of adhesive tape.

If a long length of fringe is required the combs 16A, 16B may be recycled in the slots 14 downstream of combs 16C, 16D and all four combs 16A, 16B, 16C and 16D may be slid in the slots so that combs 16C and 16D are in the positions originally held by combs 16A and 16B. Alternatively or additionally a set of 6 combs 16A, 16B, 16C, 16D, 16E and 16F may be recycled in pairs (See FIGS. 6E and 6G).

Figure 3:
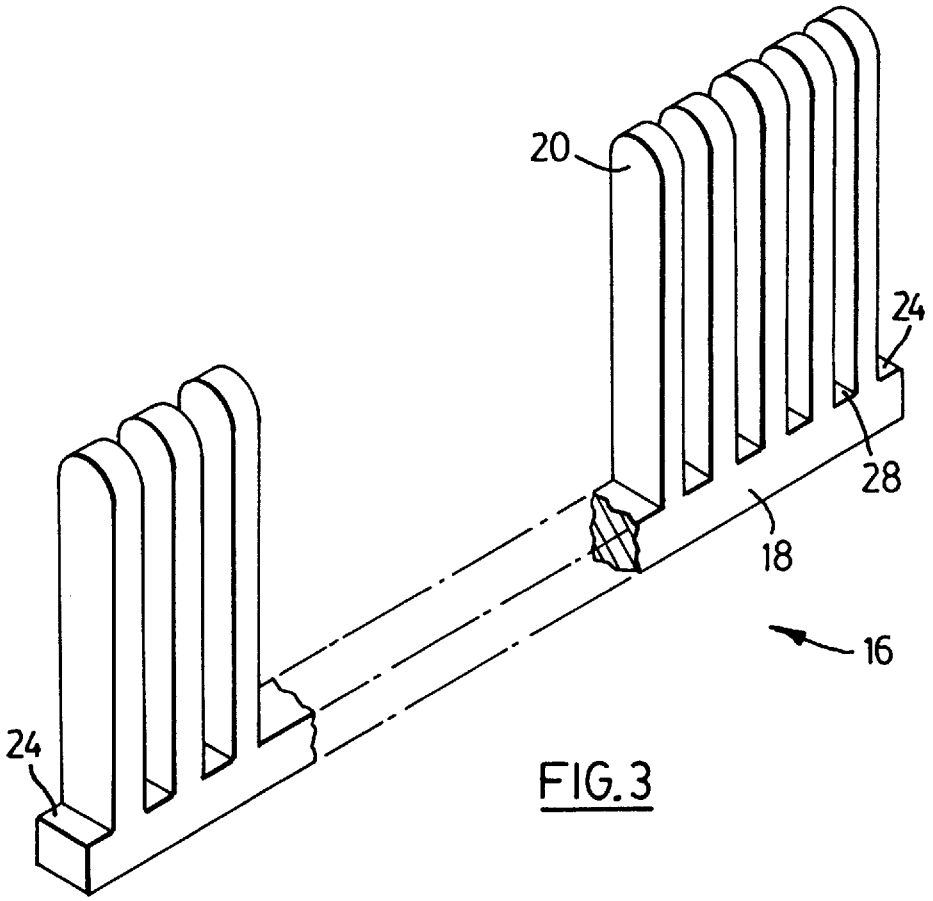
FIG. 3 is an enlarged view of one of the combs shown in FIG. 2.

As may be best seen from FIG. 3 the combs 16 should preferably be formed so that thread or yarn pulls easily between the teeth 20 without any tendency to cut the yarn or tangle it. Thus the surface 22 of the spine into which the teeth root may be flat or slightly curved. A V-angle between the teeth should be avoided and a knife edge between the edge should also be avoided.

The spacing between the teeth should, of course, be regular. It is dependent upon the thickness of yarn to be used in order to form the tassel or fringe. The apparatus may be provided with various sets of combs in which the teeth have different spacing so that it is suitable for use with fine or thick yarns. In general terms a spacing between the teeth of around 1/16 of an inch may be suitable. For this spacing, the teeth should also have a thickness of 1/16 of an inch. Clearly these spacings and thicknesses are not critical and it is envisaged that larger or smaller spacings and teeth is possible.

The spine 18 may project beyond the teeth 20 in the elongate direction of a comb 16 at both ends to form an abutment 24 for the next adjacent comb. The thickness of the abutment 24 may be half the distance between teeth 20. Such abutments may help the operator maintain regularity of spacing between strands of a fringe. Of course, an abutment having a thickness similar to the distance between teeth 20 may be provided at only one end of the comb.

Conveniently, the apparatus may be provided with a set of six combs in which the teeth have similar thicknesses and spacings.

The board 12 may be provided with slots 14 spaced from one another in multiples in a first chosen strand length. Alternatively, slots 14 may be spaced to provide strands of only slightly increased length for each consecutive slot 14.

Figure 7A:
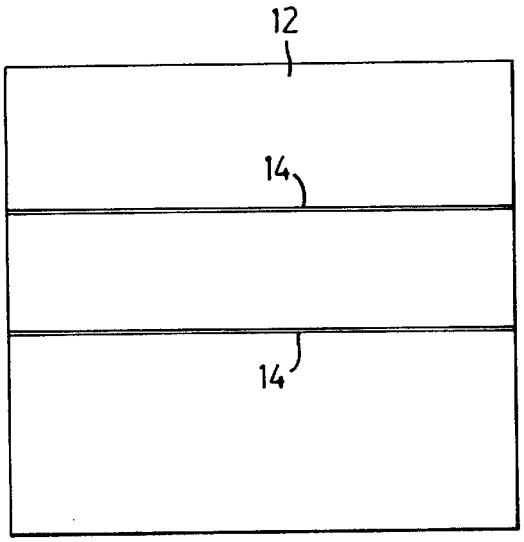
FIGS. 7A, 7B and 7C show variations in the pattern of support slots on a support board.
Figure 7C:
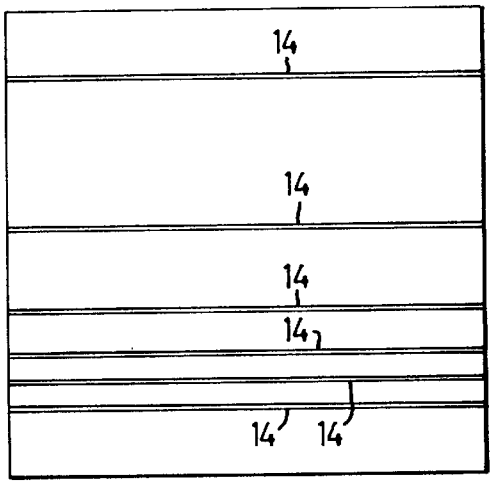
Figure 7D:
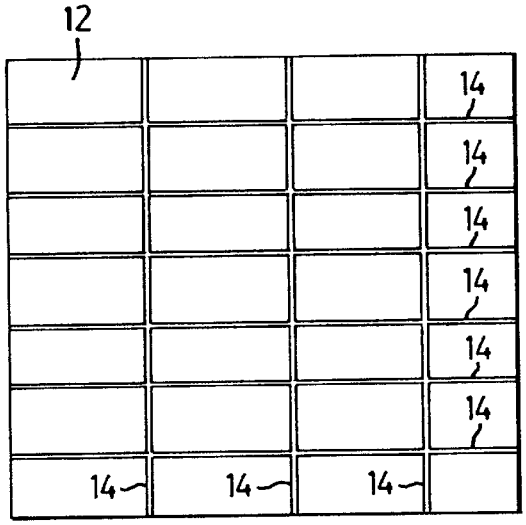

A variety of alternative arrangements of slots 14 on board 12 are illustrated in FIG. 7A, 7B, and 7C. FIG. 7A shows the simplest possible board in which only two slots are provided. Such a board can only be used to produce a fringe or tassel having strands of one length. The board of FIG. 7B may be used to provide fringes or tassels having a first length or fringes or tassels having strands which are multiples of the first length. FIG. 7C shows a board which may be used to produce fringes or tassels having a strand length which varies widely.

The use of slots running in each direction allows greater variation in the choice of strand length for the fringes or tassels.

Figure 8A:
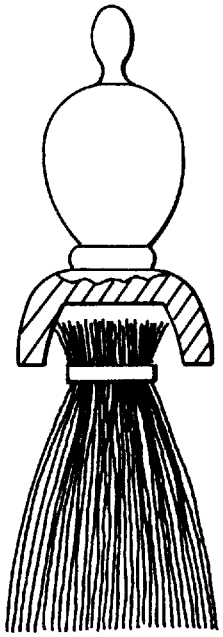
FIGS. 8A and 8B show a tassel with a decorative cap according to the invention.
Figure 8B:
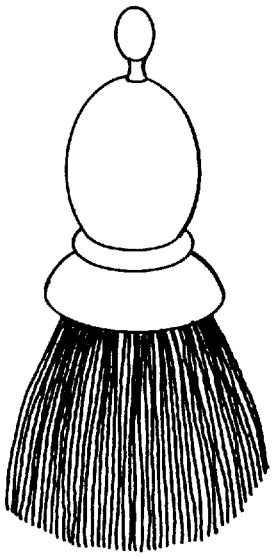

FIGS. 8A and 8B show completed tassels 30 each having a decorative end cap 32. An end 34, possibly the end of yarn from which work is begun, is left long with respect to the top of the tassel 30. End 34 is then threaded through a central aperture 36 of the end cap 32 and secured by any conventional means, e.g. knot 38.

I claim:

1. A method of forming a fringe or tassel comprising:

winding yarn in zig-zag fashion around constructive upstanding teeth of a pair of parallel combs located in support means therefor; and applying adhesive in a line parallel to the combs across resulting wound yarn removing the yarn from the teeth; and, if a tassel is required, rolling the removed fringe to form a tassel.

2. A method as claimed in claim 1 including the step of rolling the removed fringe to form a tassel and providing a suspension thread at a top end of the tassel and threading said suspension thread through a central aperture of a decorative cap.

3. Apparatus for making decorative fringes and/or tassels comprising:

a plurality of combs, each of which has an elongate spine and a row of teeth projecting from the spine;

means to releasably support at least one pair of said combs with their spines parallel and their teeth upstanding to be slidable in an axial direction, said means comprising a base having at least one pair of parallel grooves each groove being dimensioned to hold the spine of one comb of the pair of combs, the grooves being spaced apart by a distance corresponding to a prechosen strand length for the fringe or tassel.

4. Apparatus as claimed in claim 3 in which the grooves are open ended.

5. Apparatus as claimed in claim 4 in which each groove has a length sufficient to accommodate two or more combs in end to end relationship.

6. Apparatus as claimed in claim 3 in which the grooves are of keyhole cross section and in which each spine has a corresponding cross section.

7. Apparatus as claimed in claim 3 in which the grooves are of U-shaped cross section and each spine has a corresponding cross section.

8. Apparatus as claimed in claim 3 in which each comb has an abutment at each end of a length corresponding to half the distance between two adjacent teeth.

9. Apparatus as claimed in claim 3 in which the distance between two adjacent teeth of a comb is equal to the thickness of each tooth in the axial direction of the comb.

10. Apparatus as claimed in claim 9 in which the distance between two adjacent teeth of a comb is about 1/16 of an inch.

* * * * *